US006127981A

United States Patent [19]

Pritchett et al.

[11] Patent Number: 6,127,981

[45] **Date of Patent: *Oct. 3, 2000**

[54] PHASED ARRAY ANTENNA FOR RADIO FREQUENCY IDENTIFICATION

[75] Inventors: Don Michael Pritchett, Apalachin; Matthew J. Milicic, Jr., Newark Valley; Edward E. Greene, Barton, all of N.Y.

[73] Assignee: Lockheed Martin Corporation, Bethesda, Md.

[ * ] Notice: This patent issued on a continued prosecution application filed under 37 CFR 1.53(d), and is subject to the twenty year patent term provisions of 35 U.S.C. 154(a)(2).

[21] Appl. No.: 08/899,166

[22] Filed: Jul. 23, 1997

Related U.S. Application Data

[63] Continuation of application No. 08/542,755, Oct. 13, 1995, Pat. No. 5,686,928.

[51] Int. Cl.[7] ..... H01Q 21/12

[52] U.S. Cl. ..... 343/711; 343/814; 343/853

[58] Field of Search ..... 343/711, 814–816, 343/821, 795, 853; 340/572; H01Q 1/32, 21/00, 1/30

[56] References Cited

U.S. PATENT DOCUMENTS

| | | | |
|---|---|---|---|
| 3,681,769 | 8/1972 | Perrotti et al. | 343/814 |
| 3,750,185 | 7/1973 | Evans | 343/815 |
| 3,845,490 | 10/1974 | Manwarren et al. | 343/821 |
| 4,075,632 | 2/1978 | Baldwin et al. | 342/44 |
| 4,287,518 | 9/1981 | Frosh et al. | 343/700 MS |
| 4,460,877 | 7/1984 | Sterns | 333/26 |
| 4,495,505 | 1/1985 | Shields | 343/821 |
| 4,739,328 | 4/1988 | Koelle et al. | 342/44 |
| 4,800,393 | 1/1989 | Edward et al. | 343/821 |
| 4,847,626 | 7/1989 | Kahler et al. | 343/700 MS |
| 5,087,922 | 2/1992 | Tang et al. | 343/814 |
| 5,258,770 | 11/1993 | Jones et al. | 343/853 |
| 5,440,318 | 8/1995 | Butland et al. | 343/815 |

FOREIGN PATENT DOCUMENTS

| | | | |
|---|---|---|---|
| 0062089 | 6/1978 | Japan | 343/711 |
| 58-62902 | of 1983 | Japan | 343/795 |
| 0092611 | 4/1989 | Japan | 343/711 |

OTHER PUBLICATIONS

IBM Technical Disclosure Bulletin vol. 37, No. 06A, Jun. 1994, pp. 145–146, 343/711.

*Primary Examiner*—Michael C. Wimer

[57] ABSTRACT

A multi-element, H plane, phase, dipole array antenna has a high gain over a wide angle in azimuth and over a controlled sector in elevation. Two printed wiring boards feed and physically support the dipole antenna elements. The phase and spacing of the dipole elements establish the radiation elevation angle, and a planar metallic reflector, spaced on the order of a half wavelength of the RF signal from the dipole array, interacts with the dipole-element pattern, to provide the wide angle azimuth gain.

2 Claims, 10 Drawing Sheets

PHASED ARRAY ANTENNA FOR RADIO FREQUENCY IDENTIFICATION

This application is a continuation application Ser. No. 08/542,755 of Don M. Pritchett et al., filed Oct. 13, 1995, entitled 'Phased Array Antenna for Radio Frequency Identification now U.S. Pat. No. 5,686,928.'

BACKGROUND OF THE INVENTION

1. Field of the Invention

This invention relates to compact, phase array antennas and, more particularly, to a phase array antenna for use in a vehicular radio frequency identification system.

2. Background of the Invention

As will be appreciated by those skilled in the art, railroads are beginning to use a radio frequency identification (RFID) systems to keep track of their rolling equipment. As illustrated in FIG. 1, in such RFID systems, a tag 10 attached to the side of a moving railroad car responds to interrogation signals from a trackside antenna 12. Coded information about the passing railroad car is received by the trackside RFID equipment. Reliable operation depends on a sustained RF link between the fixed trackside antenna 12 and the moving tag antenna 10 so that multiple cycles of sequentially-coded data are transmitted and received.

Where there are adjacent parallel tracks, the tags on the inside car surfaces (i.e. the car surface between the two tracks) must be read by a low-profile trackside antenna. The top surface of a trackside antenna for such an interior antenna must be close to the ground (i.e. not extend above the rail), both by regulation, and by the nature of its environment. Also, because of the limited space between tracks, the trackside antenna is necessarily close to the passing RFID tags. These geometric factors create a very unfavorable situation for the antenna-to-antenna link: the effective gain of the railroad tag antenna in the direction of the trackside antenna is suppressed, and the overlap of the two antenna patterns tends to be brief because of the rapidly-changing angular geometry and the directive nature of the patterns. The relatively weak link, which exists for only a short duration using prior art trackside antennas, produces unreliable tag reads.

SUMMARY OF THE INVENTION

An object of this invention is the provision of a fixed, restricted-height antenna, which provides enhanced tag illumination in a radio frequency identification system.

Another object of this invention is the provision of a mechanically simple, printed circuit antenna array with a printed circuit unbalanced to balanced feed, so that critical parts of the assembly can be readily manufactured using printed wiring technology.

Briefly, this invention contemplates the provision of a multi-element, H plane, phase, dipole array antenna with a useful gain over a wide angle in azimuth and over a controlled sector in elevation. Two printed wiring boards feed and can support the dipole antenna elements. The phase and spacing of the dipole elements establish the radiation elevation angle, and a planar metallic reflector, spaced on the order of a half wavelength of the RF signal from the dipole array, interacts with the dipole-element pattern, to provide the wide angle azimuth gain.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1:
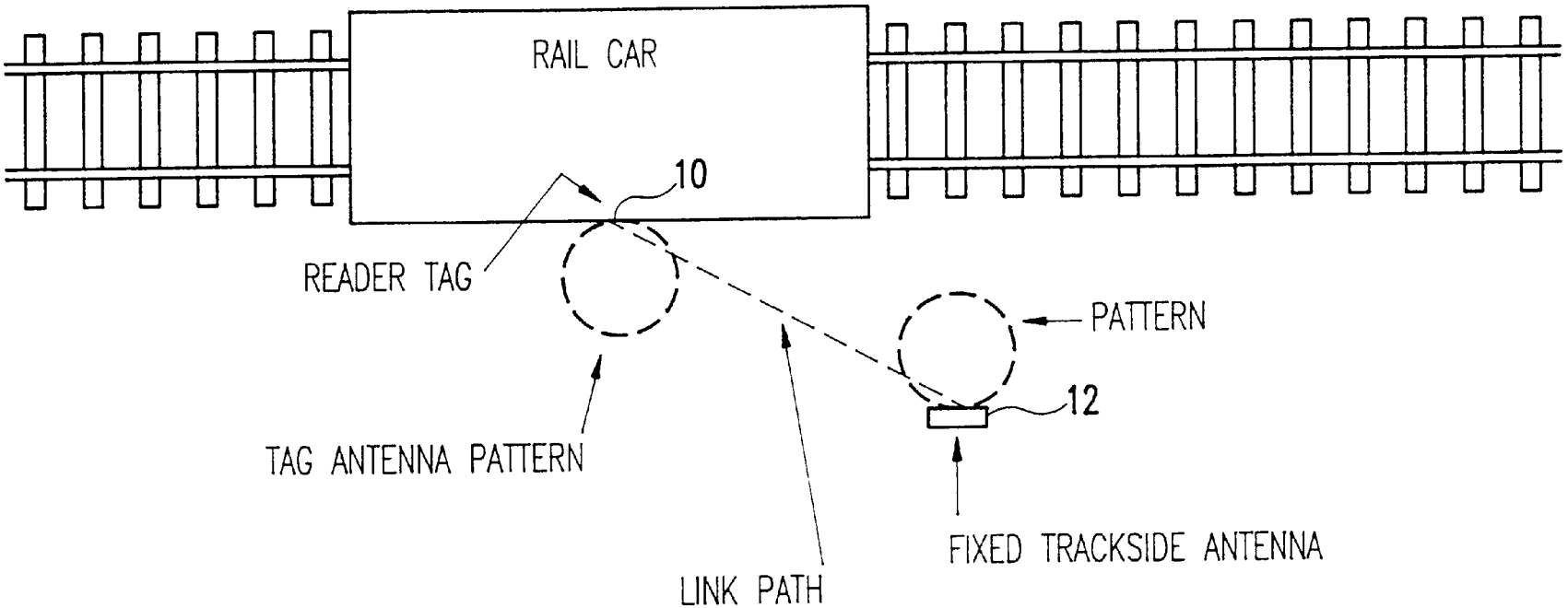
FIG. 1 PRIOR ART
FIG. 1 is a pictorial diagram illustrating the limitations of the track-based antennas used in prior art railroad, radio-frequency identification systems.
Figure 2:
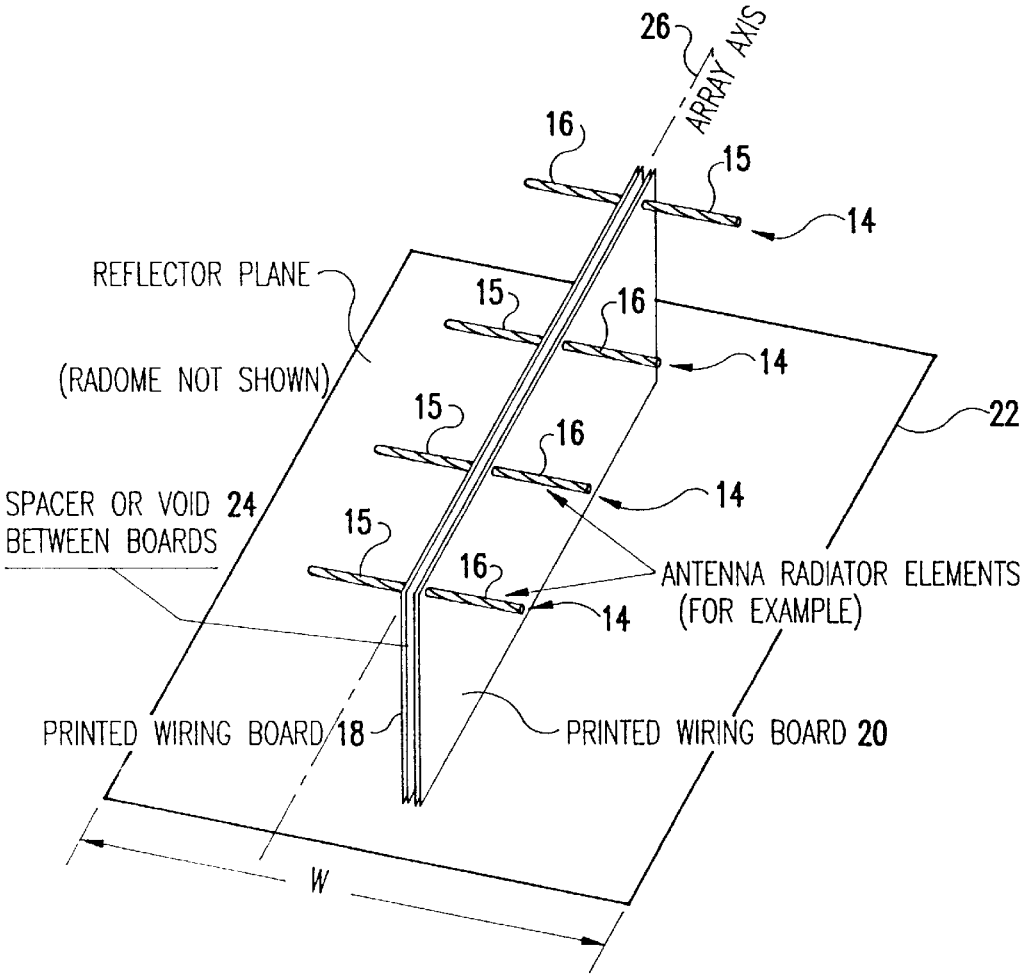
FIG. 2 is a schematic, isometric drawing of one embodiment of an antenna in accordance with the teachings of this invention.
Figure 2A:
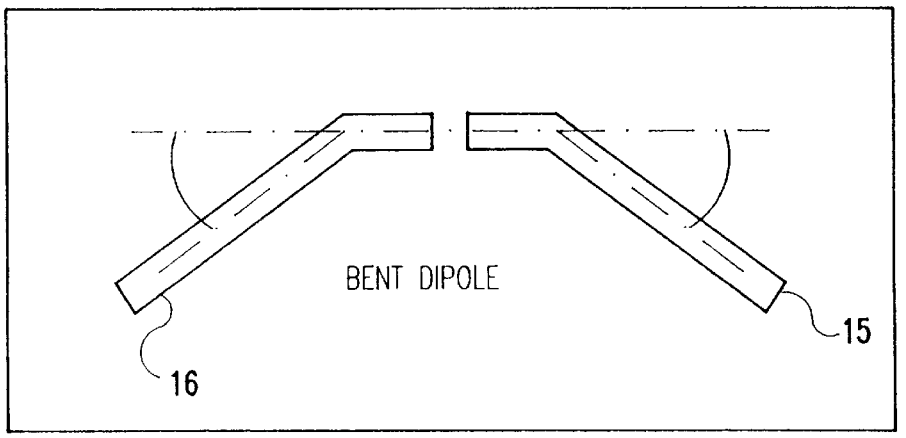

Referring now to FIG. 2, four dipole antenna elements 14, each comprised of a pair of radiation elements 15 and 16, are supported by and fed by a pair of printed circuit boards 18 and 20. The antenna elements are arranged in an H plane array; i.e. the E planes of all elements are parallel and the H planes of all elements are coplanar. The radiation elements 15 and 16 are shown here as simple metal rods, but other dipole geometries may be used, such as the bent dipole geometry shown in the inset to FIG. 2. A metallic reflector 22 is disposed approximately 0.5 RF wavelengths from the dipole array (with the best spacing a function of the overall geometry). As will be explained more completely in connection with FIGS. 6–9, there is a space 24 between the boards 18 and 20, and traces on the boards form broadside coupled stripline transmission paths to feed the elements 15 and 16 in a desired phase relationship. The space 24 may be essentially void or may be filled with dielectric material appropriate to the electrical and mechanical design. The stripline terminology refers to a symmetrical pair of flat conductors forming a balanced configuration rather than the commonly used triplate (unbalanced) stripline configuration. The array axis 26 is along the line which connects the centers of all the array elements.

Figure 3:
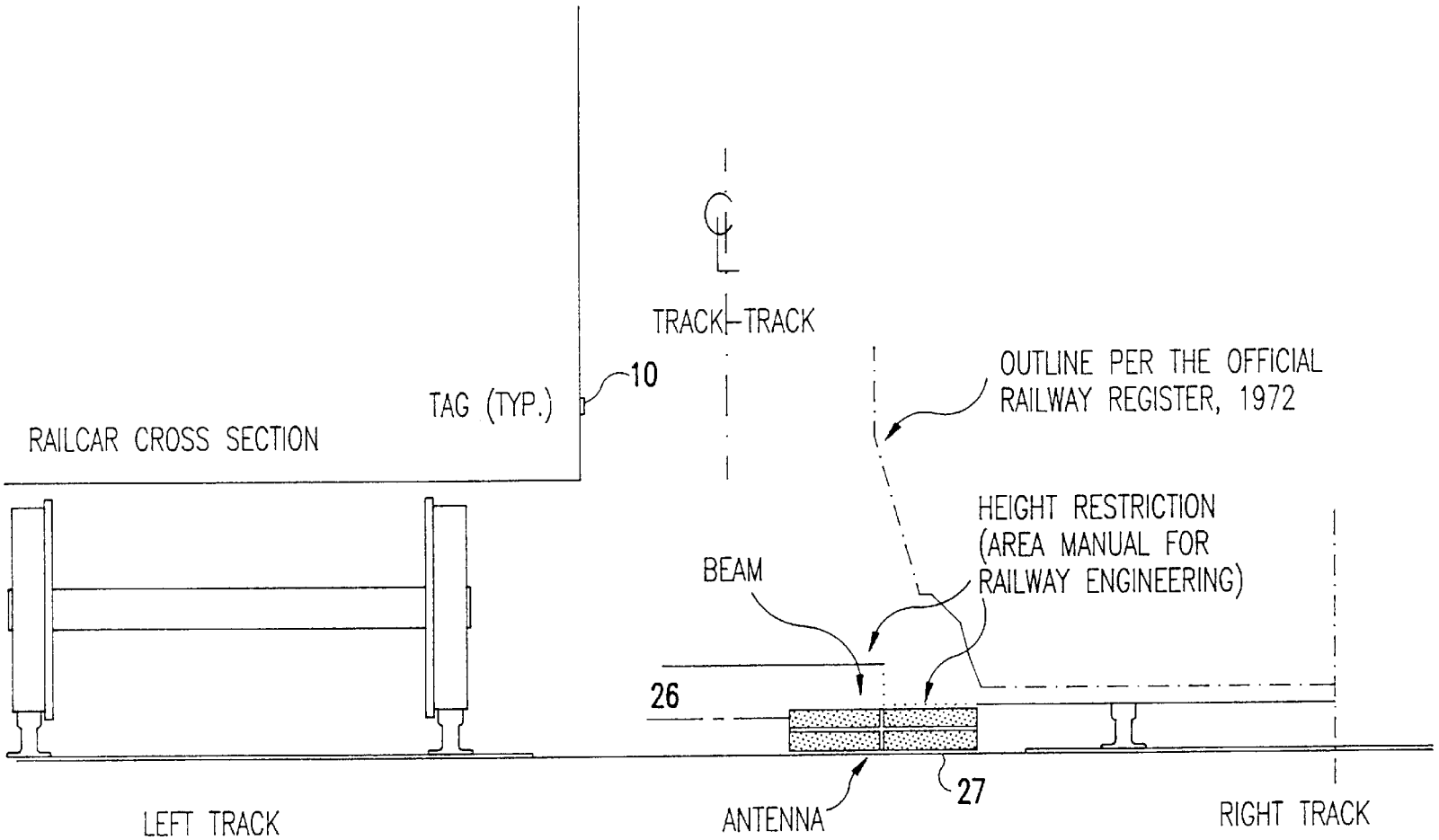
FIG. 3 is a pictorial diagram of a railroad, radio-frequency identification system with an antenna installation in accordance with the teachings of this invention.
Figure 4A:
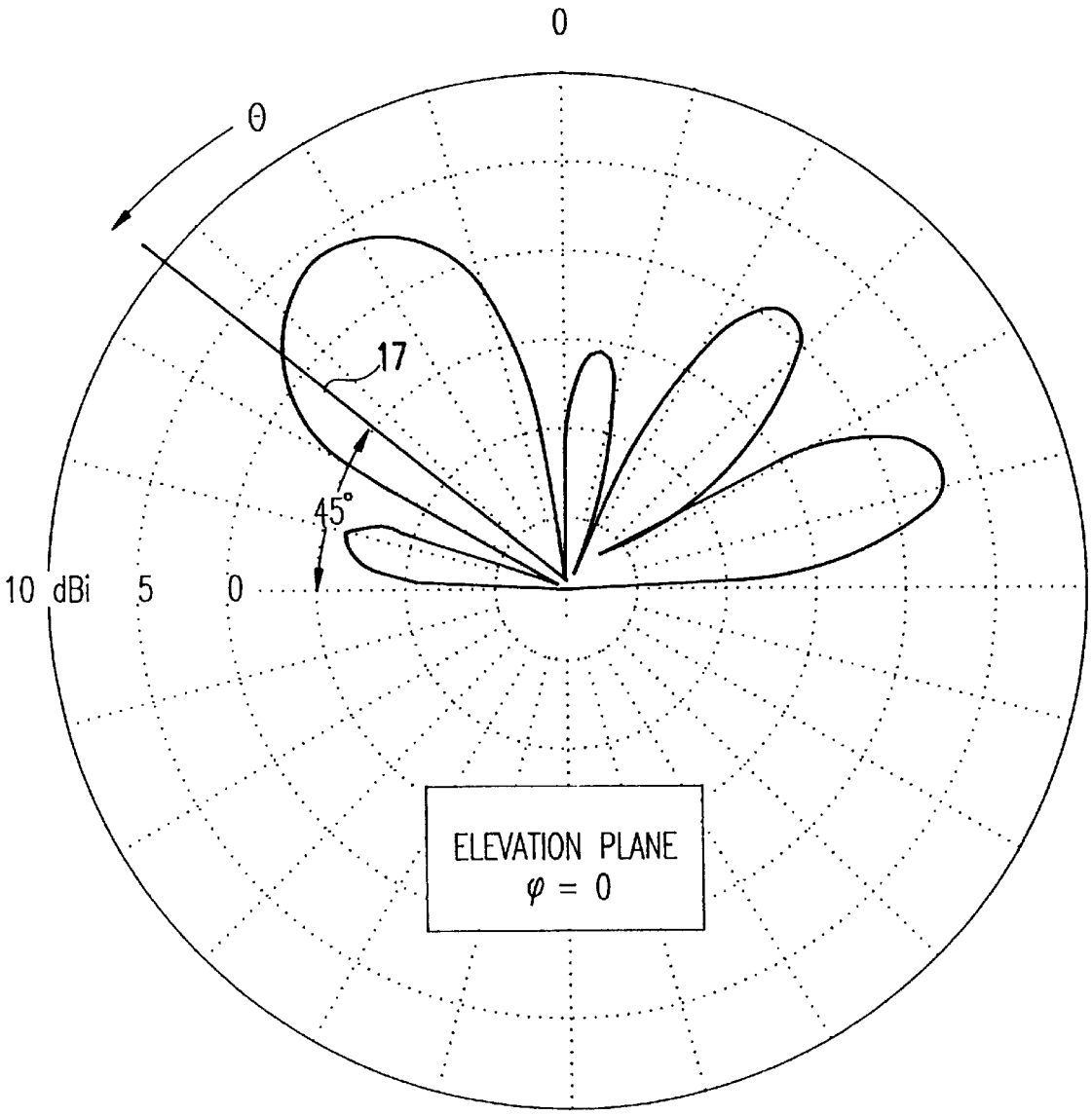
FIG. 4A is a polar plot of an example of a radiation pattern, in elevation, of a phase array antenna in accordance with the teachings of this invention.
Figure 4B:
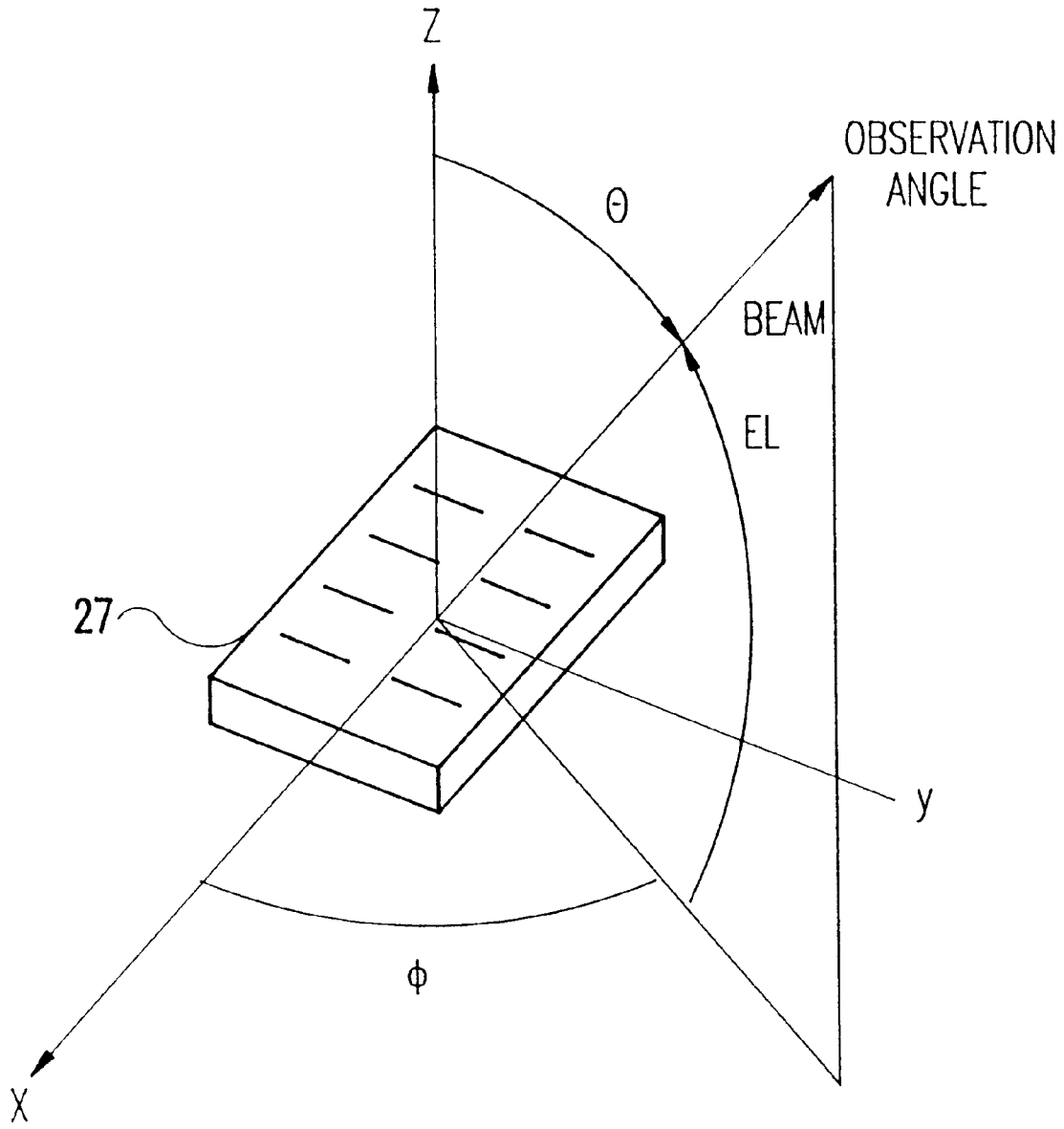
FIG. 4B is representation of a rectangular and spherical coordinate system showing the antenna of the present invention at the origin and defining the angles $\Theta$, and $\phi$ used in the polar plots of FIGS. 4A and 5, relative to the rectangular coordinate system.

FIG. 3 depicts the antenna shown in FIG. 2 installed between parallel sets of railroad tracks. The antenna includes a radome housing 27 for protection from weather and other things in the environment which would adversely effect the antenna operation. The radome cover can be fabricated of commonly available plastic, such as polycarbonate. The overall height of the antenna allows it to be placed on the ground below level of the top-of-rail. With the antenna in position to read tags, the array axis 26 is normal to the track path and the antenna beam is tilted, by phasing, toward the passing tags 10 as illustrated, with a beamwidth, in elevation, designed to illuminate as strongly as practical the range in elevation where the tag may be located (24" to 60" above rail). FIG. 4A shows an example of a desired pattern in elevation. In the installation of FIG. 3, the principal lobe axis 17 of beam pattern is angled upwardly at about a 45° angle so the beam intersects the tag path. FIG. 4B shows that angle $\Theta$ is measured from the z axis to the beam. The angle $\phi$ is measured from the x axis to the projection of the beam in the x-y plane.

Figure 5:
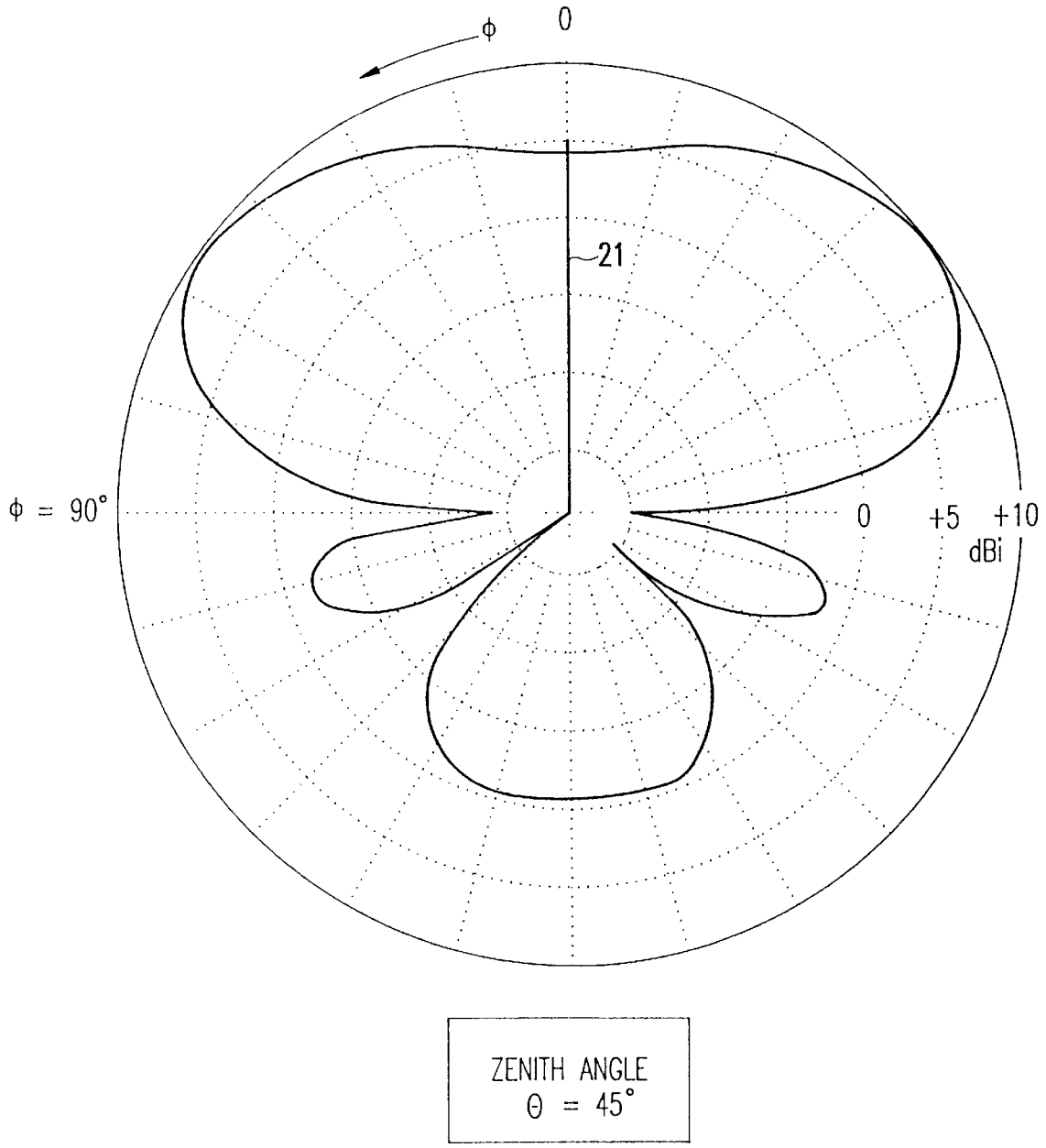
FIG. 5 is a polar plot of an example of the radiation pattern, in azimuth, of the antenna, created by taking a $\Theta$=45° conical cut of the pattern shown in FIG. 4A. The conical cut creates a surface representation of the antenna gain.

The azimuth pattern of the antenna (i.e. the pattern along the path of the passing railroad car tags) is shaped as shown in FIG. 5 to enhance the power transfer between the tags 10 and the trackside antenna 12 as they approach one another and depart from one another. The gain on either side of the principal lobe axis in azimuth 21 is relatively flat or is enhanced depending on zenith angle. The depressed gain near the central part of the pattern is a very productive tradeoff to achieve the wide-angle character; there is a substantial increase in off-axis gain with a very tolerable loss in the overall antenna-to-tag link gain near $\phi=0$. The loss at $\phi=0$ is tolerable since the distance between the two antennas is at a minimum and the tag antenna gain is at a maximum, more than compensating for the reduction in gain in antenna 26 at $\phi=0$. The azimuth pattern characteristic is primarily a result of the shape of the dipole radiator elements 15 and 16 and the spacing of the dipole elements from the reflector 22. The polar plots of FIGS. 4A and 5 have concentric circles showing the absolute gain in decibels increasing in the radially outward direction.

The bent dipole depicted in the inset of FIG. 2 contributes additional radiation at wide angles compared to a straight dipole. Also, the reflection (or the image) of the dipole element spaced 0.48 wavelengths from the reflector surface produces a net pattern with the useful shape of FIG. 5. Since the reflector is a primary contributor to the wide-angle pattern, its dimension W parallel to rails is large compared to conventional reflector-backed antennas; the width W of the antenna shown in FIG. 2 has a 2.8 wavelength-wide reflector compared to a one-wavelength (or less) reflector width for a common antenna. However, those skilled in the art will recognize this as a non-critical dimension. Narrower reflectors could alternatively be used without substantial change in performance.

Figure 6:
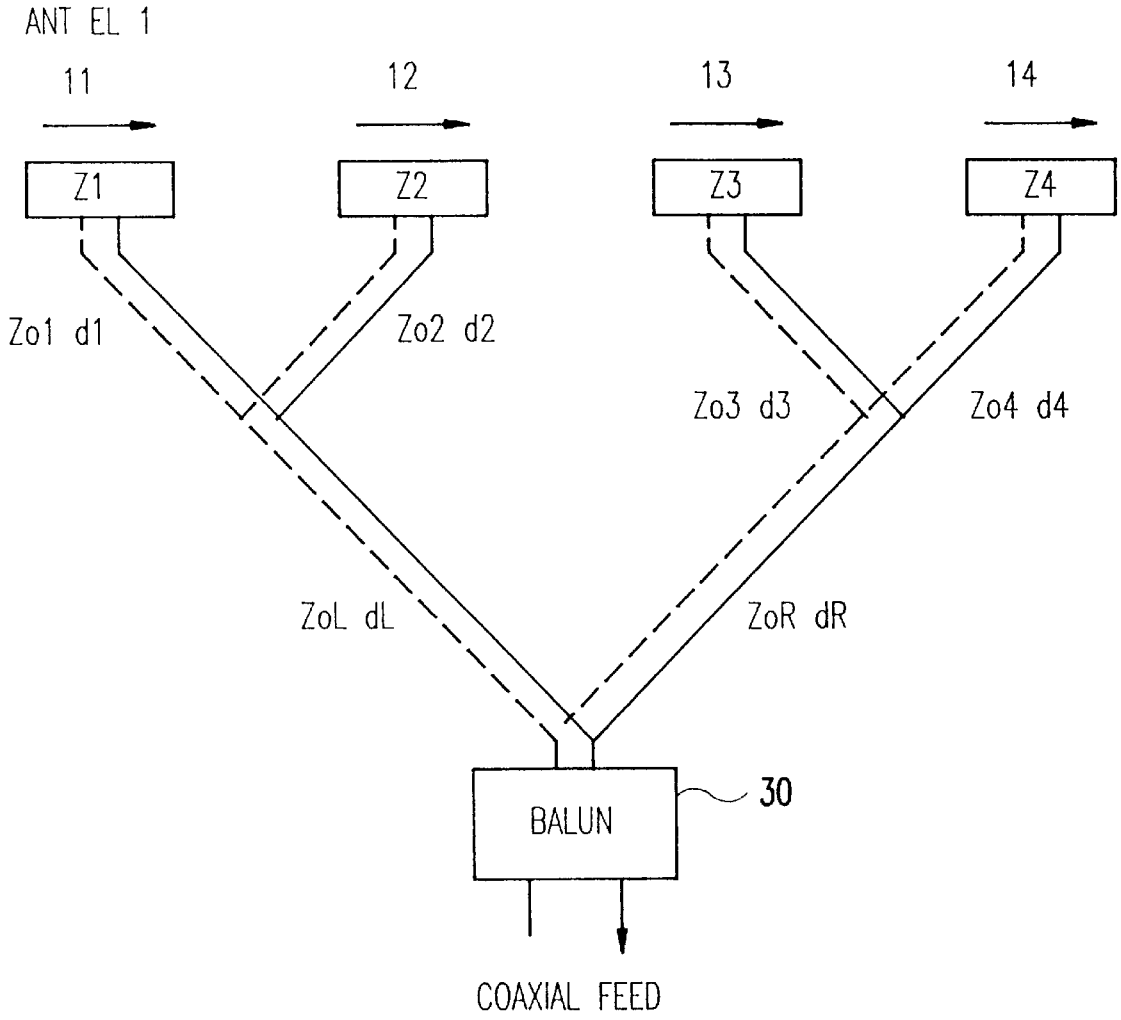
FIG. 6 is block diagram of the antenna shown in FIG. 2, constructed in accordance with the teachings of this invention.

FIG. 6 is an electrical, block diagram of the antenna shown in FIG. 2. A balun 30, which is integrated onto the circuit boards 18 and 20, provides a conversion and impedance matching from an unbalanced coaxial input 32 to a stripline feed network comprised of a "tree" of balanced transmission lines of various characteristic impedances labeled ZoL, etc., and electrical lengths labeled dL, etc. The antenna element loads are shown as boxes with Z1, Z2, Z3 and Z4. The impedance Z and length d of each stripline branch of the tree is selected to excite the antenna elements with phase displaced currents I1, I2, I3 and I4 so that the array gives a desired pattern factor in elevation. The parameters Z and d, which determine the element-to-element phase shift, can be determined by transmission-line circuit analysis, with due treatment of the mutual coupling of antenna elements. For example, to achieve the elevation pattern of FIG. 4A, the distribution network parameters (Z, d) were adjusted to give a nominally uniform amplitude distribution with a progressive phase shift of 100 degrees per element in an array with an element-to-element spacing of 0.58 wavelengths. This simple design is not broadband, but has more than adequate bandwidth for many applications.

Figure 7A:
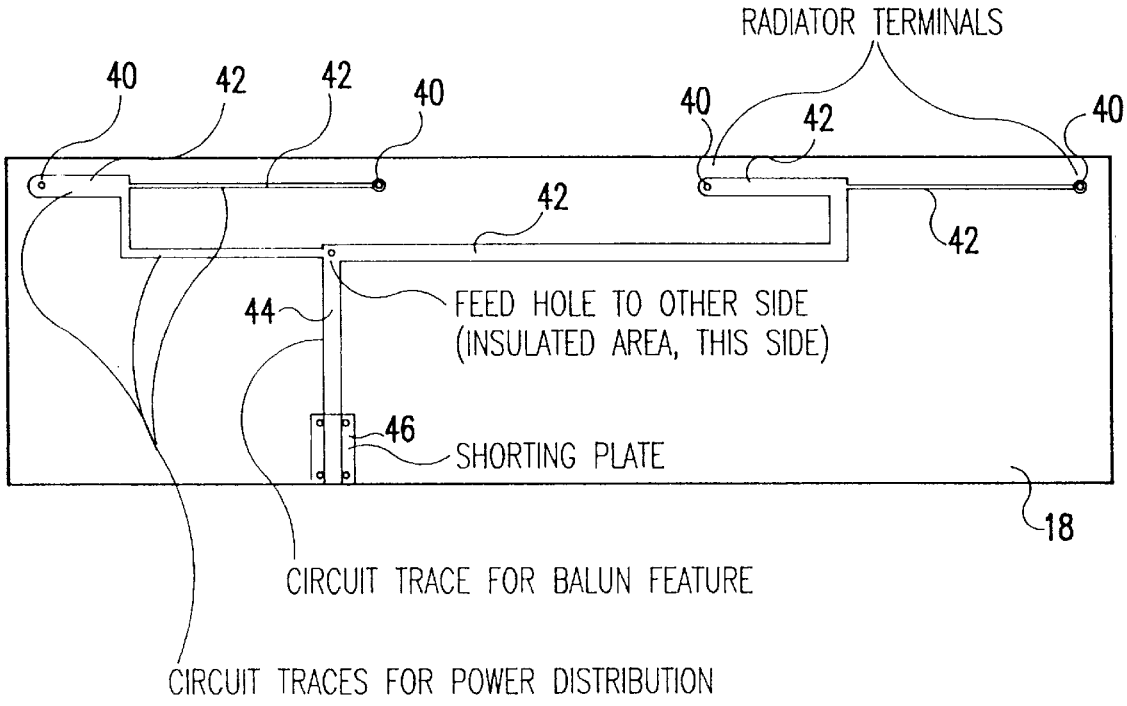
FIGS. 7A and 7B are plan views of a printed circuit board pair used to construct the antenna shown schematically in FIG. 6.
Figure 7B:
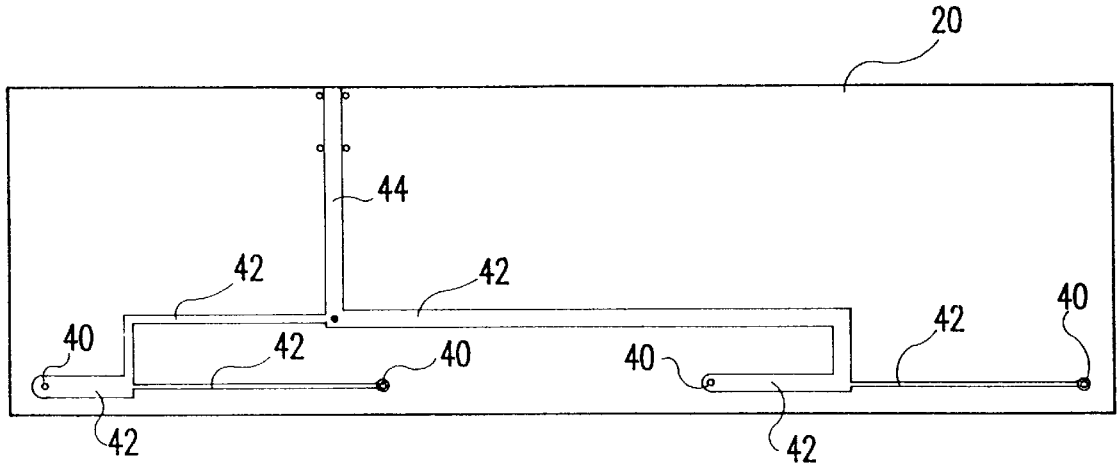

FIGS. 7A and 7B show respectively the surfaces of the boards 18 and 20 that face one another when the boards are assembled. FIG. 7B is up-side-down with respect to FIG. 7A. Each board has four antenna element terminals 40 to which the elements 15 and 16 are respectively electrically and mechanically coupled. For RF power distribution to the terminals 40, each board has a set of circuit traces 42 extending horizontally from a vertical circuit trace 44 that form components of the balun. It will be appreciated that when the boards 18 and 20 are assembled, the traces on their interior surfaces shown here match up with one another and form strip transmission lines for the RF power. The corresponding trace patterns while preferably on the interior surface of the boards, as shown, could alternatively be positioned on the exterior surfaces of the boards. Varying the width and board-to-board spacing of the circuit traces of the power distribution network varies the impedance of the resulting strip transmission lines from the balun to the dipole elements 15 and 16 and the combination of variations in impedance and length from one element to the next varies the relative phase of the excitation of the respective dipole elements.

As will be appreciated by those skilled in the art, printed circuit baluns (i.e. unbalanced to balanced signal transformation devices) have been proposed to provide interface signal matching from a coaxial feed line to a printed circuit dipole antenna. The balun structure here, comprises, in addition to the vertical stripline transmission line formed by the traces 44 on each board, a shorting plate 46 on the interior surface of the board 18. Plate 46 shorts the vertical trace 44 on board 18 to a corresponding section of the vertical trace on board 20, so that the remaining (unshorted) parts of the vertical traces form a balanced quarter-wavelength stub in parallel with the balanced feed point near the feed hole.

Figure 8A:
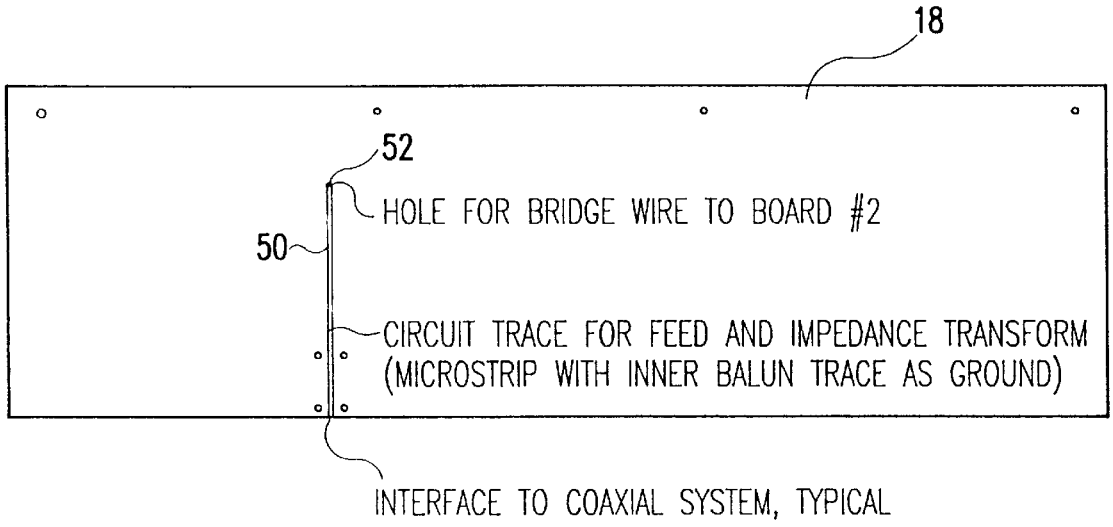
FIGS. 8A and 8B are plan views of the opposite sides of the printed circuit boards shown in FIGS. 7A and 7B.
Figure 8B:
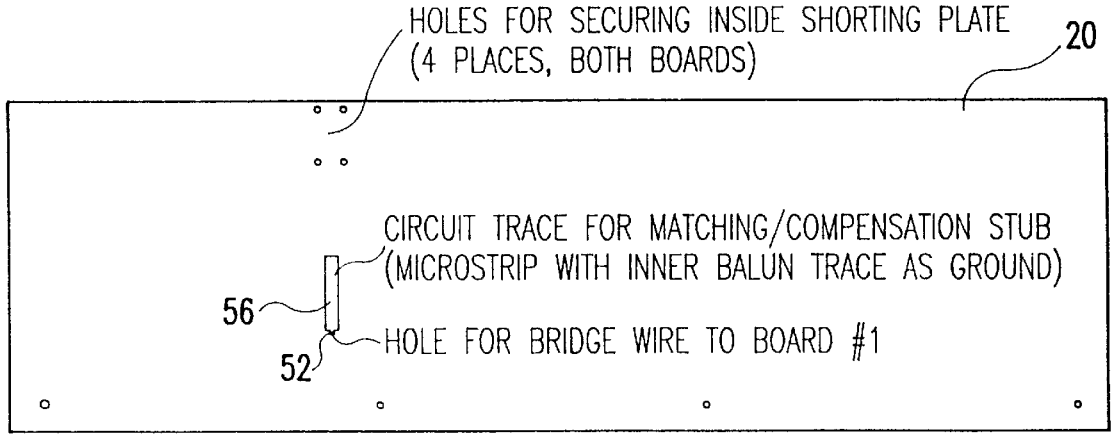
Figure 9:
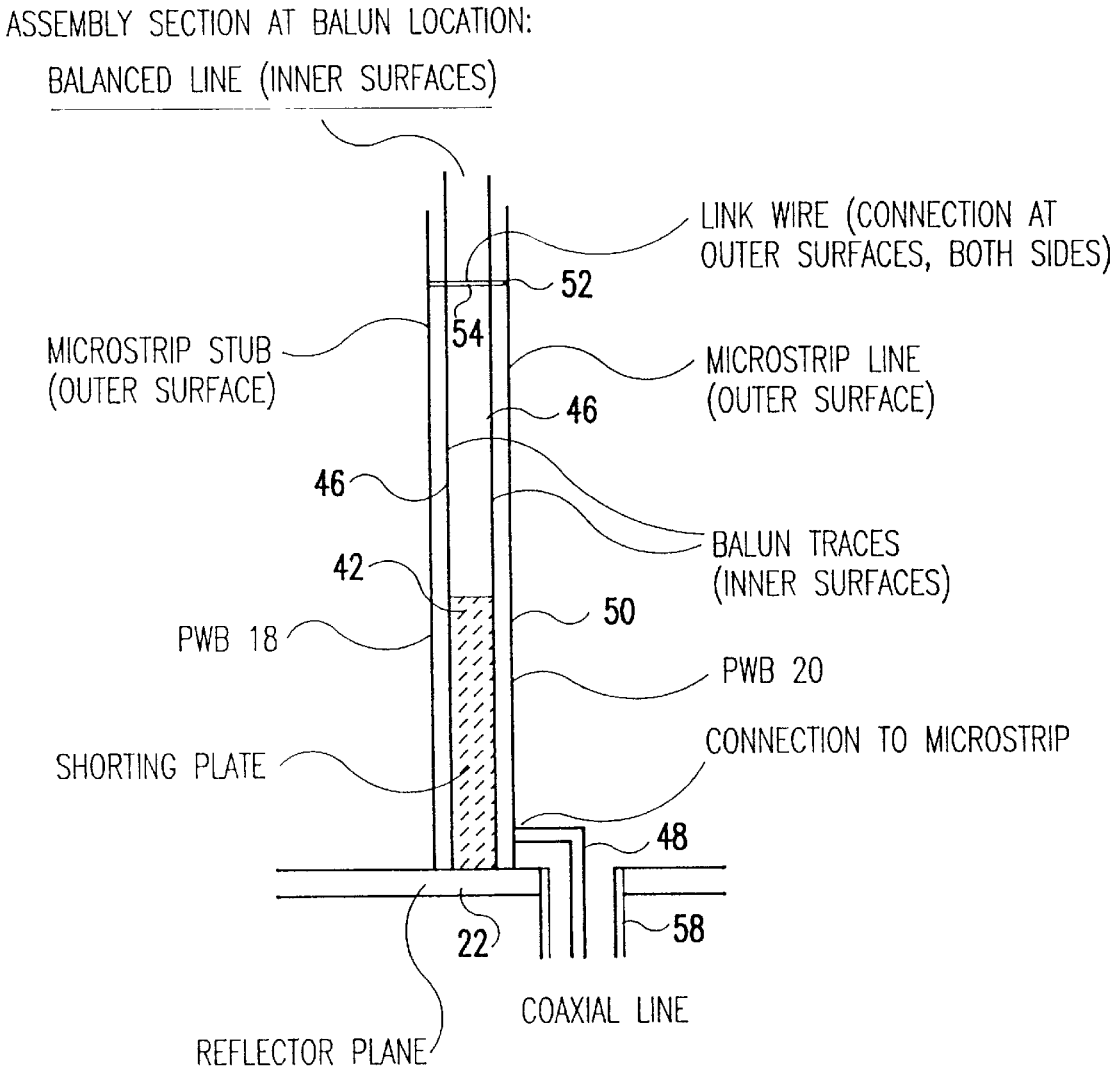
FIG. 9 is a sectional view of the assembled printed circuit board pair taken at the balun location.

As can be seen in FIGS. 8A and 8B and FIG. 9, a central conductor 48 of a coaxial feed is connected to a circuit trace 50 on the outer surface of printed circuit board 18, and forms a microstrip transmission line with the vertical trace 44 on the interior surface of the board 18. This trace 50, which is a component of the balun, extends to a hole 52, through which extends a bridge wire 54, connecting the trace 50 to a circuit trace 56 on the outer surface of board 18. The bridge wire is insulated from the interior traces 44 on each board allowing only the direct electrical connection between the traces on the exterior surfaces of the boards. This topology, using an insulated through hole permits proper excitation of the interior traces 40, 42, and 44 by means of electromagnetic coupling. Circuit trace 56, which forms a microstrip transmission line with the vertical trace 46 on the inner side of the board, serves as an impedance matching and compensation stub in the balun. As shown in FIG. 9, the outer conductor 58 of the coaxial feed is connected, via the reflector 22, to the shorting plate 42 and the circuit traces 50 on the outer surface of the printed circuit board 18.

While the invention has been described in terms of a single preferred embodiment, those skilled in the art will recognize that the invention can be practiced with modification within the spirit and scope of the appended claims.

Having thus described our invention, what we claim as new and desire to secure by Letters Patent is as follows:

1. A radio-frequency interrogation method for reading a transponder tag on an object moving with respect to a surface as the transponder tag moves along a path past a fixed position adjacent said path, including the steps of:

stationing at said fixed position a phase array antenna comprised of a plurality of dipole radiating elements disposed adjacent said path in a plane parallel to said surface; and energizing said antenna array to irradiate said transponder tag with a radio-frequency beam whose principal lobe axis in an elevation direction is directed from said fixed position so said beam intersects said path and whose gain in an azimuth direction along said path on either side of the principal lobe axis in an elevation direction is greater than the gain along said principal lobe axis in azimuth, so that the coupling between said tag and said antenna is extended in azimuth as said tag approaches toward and recedes from said antenna along said path, and said coupling is maintained when said tag intersects said principal lobe axis.

2. A radio frequency interrogation method as in claim 1 wherein said fixed position is adjacent said path, said moving object is a railroad car moving on parallel tracks, and said dipole elements lie in a plane parallel to and below the plane of a tracks.

* * * * *